US012275545B2

(12) United States Patent
Hewitt et al.

(10) Patent No.: US 12,275,545 B2
(45) Date of Patent: Apr. 15, 2025

(54) LYOPHILIZED BEAD HANDLING

(71) Applicant: Mikron Corporation Denver, Englewood, CO (US)

(72) Inventors: Tod Sean Hewitt, Bennett, CO (US); Giridhar Shamsunder, Pittsboro, NC (US); Michael B. Gunner, Highlands Ranch, CO (US); Flavio Pointet, Denver, CO (US)

(73) Assignee: Mikron Corporation Denver, Englewood, CO (US)

( * ) Notice: Subject to any disclaimer, the term of this patent is extended or adjusted under 35 U.S.C. 154(b) by 107 days.

(21) Appl. No.: 17/936,304

(22) Filed: Sep. 28, 2022

(65) Prior Publication Data

US 2023/0094031 A1 Mar. 30, 2023

Related U.S. Application Data

(60) Provisional application No. 63/249,320, filed on Sep. 28, 2021.

(51) Int. Cl.

| | |
|---|---|
| ***B65B 35/06*** | (2006.01) |
| ***B65B 1/06*** | (2006.01) |
| ***B65B 1/38*** | (2006.01) |

(52) U.S. Cl.

CPC ..... *B65B 35/06* (2013.01); *B65B 1/06* (2013.01); *B65B 1/38* (2013.01)

(58) Field of Classification Search

CPC .... B65B 1/04; B65B 1/06; B65B 1/16; B65B 1/30; B65B 1/38; B65B 35/00; B65B 35/06

See application file for complete search history.

(56) References Cited

U.S. PATENT DOCUMENTS 3,200,858 A * 8/1965 Kampert ..... B60C 5/005 141/38
4,101,284 A * 7/1978 Difiglio ..... G01N 33/54366 221/95
4,415,098 A * 11/1983 Haas ..... B65D 83/0409 221/202
4,640,322 A * 2/1987 Ballester ..... B65B 1/36 222/630

(Continued)

FOREIGN PATENT DOCUMENTS

WO WO-9942209 A1 * 8/1999 ..... B01J 19/0046

*Primary Examiner* — Nicolas A Arnett
(74) *Attorney, Agent, or Firm* — Davis Graham & Stubbs LLP

(57) ABSTRACT

A method and apparatus are provided for handling beads such as lyophilized beads or cryo beads to enable reliable singulation of the beads and facilitate accurate dosing. The bead handling equipment (100) includes an equipment housing (102) containing a hopper (104) and a bead dispenser (103), a gas delivery system (105), and an inspection system (120). The housing 102 may be pressurized by supplying pressurized gas to the housing 102 from the gas delivery system 105. The bead dispenser includes a piston 106 operative to singulate individual beads from the stream of beads exiting the hopper 104 and to deliver individual beads to a feed channel 108 and to a container 110. The inspection system 120 identifies bead fragments, or beads that are otherwise mis-sized, so that such beads can be rejected and not delivered to the container 110.

28 Claims, 8 Drawing Sheets

(56) References Cited

U.S. PATENT DOCUMENTS

| | | | | |
|---|---|---|---|---|
| 5,597,530 | A * | 1/1997 | Smith | A61L 2/07 422/550 |
| 5,722,470 | A * | 3/1998 | Kedar | B01L 3/0289 221/233 |
| 5,773,296 | A * | 6/1998 | Montalbano | G01N 35/1002 422/549 |
| 6,432,719 | B1 * | 8/2002 | Vann | G01N 35/1002 436/535 |
| 6,849,457 | B1 * | 2/2005 | Babson | B01L 3/0289 422/562 |
| 7,101,510 | B2 * | 9/2006 | Vann | B01L 3/0289 222/402.1 |
| 7,364,850 | B2 * | 4/2008 | Kambara | B01J 19/0046 435/174 |
| 7,975,877 | B2 * | 7/2011 | Garthaffner | B65G 47/1428 221/175 |
| 8,541,246 | B2 * | 9/2013 | Bunce | B01L 3/5085 436/518 |
| 8,769,915 | B2 * | 7/2014 | Kobayashi | B65B 39/002 53/244 |
| 8,782,999 | B2 * | 7/2014 | Kondo | B65B 5/103 53/247 |
| 8,925,708 | B2 * | 1/2015 | Cie likowski | A24D 3/0216 198/450 |
| 9,004,261 | B2 * | 4/2015 | Cie likowski | B65G 37/00 198/479.1 |
| 11,219,241 | B2 * | 1/2022 | Figarski | A24D 3/061 |
| 2006/0012130 | A1 * | 1/2006 | Vann | B82Y 30/00 277/595 |
| 2012/0138191 | A1 * | 6/2012 | Harris | B65G 53/60 141/93 |
| 2023/0410589 | A1 * | 12/2023 | Lema | G07F 13/02 |

* cited by examiner

LYOPHILIZED BEAD HANDLING

CROSS-REFERENCE TO RELATED APPLICATION

This application claims benefit of U.S. Provisional Patent Application No. 63/249,320, entitled, "LYOPHILIZED BEAD HANDLING," filed Sep. 28, 2021, the contents of which are hereby incorporated by reference in their entirety.

FIELD OF THE INVENTION

The present invention relates generally to handling of lyophilized beads such as beads of reagents for biological/pharmaceutical applications and, in particular, to a method and apparatus for singulating such beads and dispensing the beads to a container product.

BACKGROUND OF THE INVENTION

Lyophilized beads are commonly used to produce a variety of pharmaceutical or other biological products such as vaccines, vials, cartridges, or other products. In this regard, one or more active ingredients or reagents for such applications may be freeze-dried to produce a substantially spherical bead having a nominal volume of the active ingredient(s). A specified number (one or more) of the beads, e.g., depending on the desired dosing, may then be dispensed into a container where, for example, the beads are dissolved into a solution to yield a container product. In some applications, the container product may be loaded into an injector or other device to yield an end product.

The lyophilized beads simplify and optimize production of these products in a number of ways including providing the reagents in a stable form and enabling accurate dosing without the need to deliver reagents with a pipette. However, the beads are fragile, difficult to separate, and susceptible to damage that could affect dosing. As a result, it has been difficult to provide machinery for handling such beads that consistently singulates beads and delivers the beads to a container product without damage to the beads or dosing errors.

SUMMARY OF THE INVENTION

The present invention is directed to a method and apparatus for handling beads such as lyophilized beads or cryo beads. The invention enables reliable singulation of the beads to facilitate accurate dosing. In addition, the invention avoids handling difficulties or dosing errors associated with bead fragments as well as enabling rejection of mis-sized beads. The invention also enables control of the dispenser environment to reduce degradation of the beads and to enhance singulation of the beads and transportation of the beads to a container product.

In accordance with one aspect of the present invention, a method and apparatus ("utility") is provided for using pressurization to assist in singulating and transporting beads. The utility generally includes a hopper for holding a supply of beads, a bead dispenser for dispensing the beads, one at a time, to a product container, and a pressurization system. The bead dispenser receives beads from the hopper and delivers the beads to a dispensing outlet associated with the product container. The hopper and bead dispenser may be provided within an enclosure, for example, a sealed enclosure. The pressurization system maintains a positive pressure, at an internal space of the enclosure, in relation to an ambient environment. The positive pressure can thus be used to assist in securing the beads on a piston of the bead dispenser and transporting the beads from the hopper to the bead dispenser as well as to deliver the beads to the container product via the outlet.

In accordance with another aspect of the present invention, a utility is provided where beads are lifted from a bottom of a hopper to an outlet channel so as to assist in keeping bead fragments from reaching a container product or interfering with equipment operation. The utility involves a hopper for holding a supply of beads and a bead dispenser for dispensing the beads one at a time to the product container where the bead dispenser includes a piston for separating individual beads from a stream of beads exiting the hopper. The piston is configured to lift an individual bead from a bottom of the hopper to a dispensing outlet where the outlet is disposed above the bottom of the hopper. Preferably, a mechanism is provided for singulating beads to separate the target bead being delivered to the product container from other beads, e.g., by applying a force to the target bead sufficient to overcome any attractive force causing other beads to stick to the target bead. In one implementation, the piston has a central opening and a pressure differential can be applied to the opening to secure the bead on the piston which is then to operated to lift the bead. In this manner, individual beads are separated from the stream and gravity will cause any bead fragments to settle towards a bottom of the piston away from the outlet. Moreover, the bead fragments can be easily removed so that they do not accumulate and interfere with operation of the equipment.

In accordance with a still further aspect of the present invention, an inspection system is provided in connection with a bead dispenser to identify any mis-sized beads. A corresponding utility involves a hopper for holding a supply of beads, a bead dispenser for dispensing the beads, one at a time, to a container product, and an inspection system for inspecting one or more physical characteristics of the beads. For example, the inspection system may include a sensor system for sensing one or more parameters related to bead volume or mass. In one implementation, the sensor system includes a camera and the beads may be inspected to identify beads that are broken or malformed such that the volume of the bead does not match an acceptable volume limit. Any unacceptable beads may be rejected so that they are not used in container products. Proper dosing can thus be ensured as mis-sized beads are eliminated from delivery to container products.

In accordance with a further aspect of the present invention, a de-ionizer is employed to neutralize an electrical charge from gas introduced into bead handling equipment. It has been found that static electricity can cause lyophilized beads to stick together thus interfering with singulation and transporting of beads within bead handling equipment. Accordingly, an associated utility involves a housing containing a hopper for holding a supply of beads and a bead dispenser for dispensing the beads one at a time to a product container. A de-ionizer is provided for neutralizing an electrical charge of gas entering the hopper. For example, the utility may involve a source of gas and a supply line connecting the source of gas to an interior of the enclosure where the de-ionizer removes an electrical charge from the gas in the supply line. Preferably, the source of gas provides a supply of inert gas with a low relative humidity, e.g., of no more than about 10%, to the interior of the equipment.

The various aspects of the invention as noted above may be implemented individually or together in various combinations of two or more of such aspects. It will be appreciated that such combinations may yield synergies in relation to certain advantages or objectives of the present invention as noted herein or otherwise realized in relation to such combinations. Additional aspects of the invention and alternatives, modifications, or additions relative to the various aspects of the invention will be understood from the description below.

BRIEF DESCRIPTION OF THE DRAWINGS

For a more complete understanding of the present invention and further advantages thereof, reference is now made to the following detailed description, taken in conjunction with the drawings, in which.

DETAILED DESCRIPTION

The present invention is directed to bead handling equipment with particular advantages related to handling of lyophilized beads for pharmaceutical/medical applications among others. In the following description, particular embodiments of the invention are described that employ, among other things, specific structure for singulating beads and delivering beads to an outlet, systems for delivering dry, de-ionized gas to the equipment, pressurizing the equipment, and identifying/rejecting mis-sized beads. While these embodiments represent particularly advantageous implementations of the present invention, the invention is not limited to these particular embodiments and implementations or to specific combinations of these features. Accordingly, the following description should be understood as exemplary and not by way of limitation.

Figure 1:
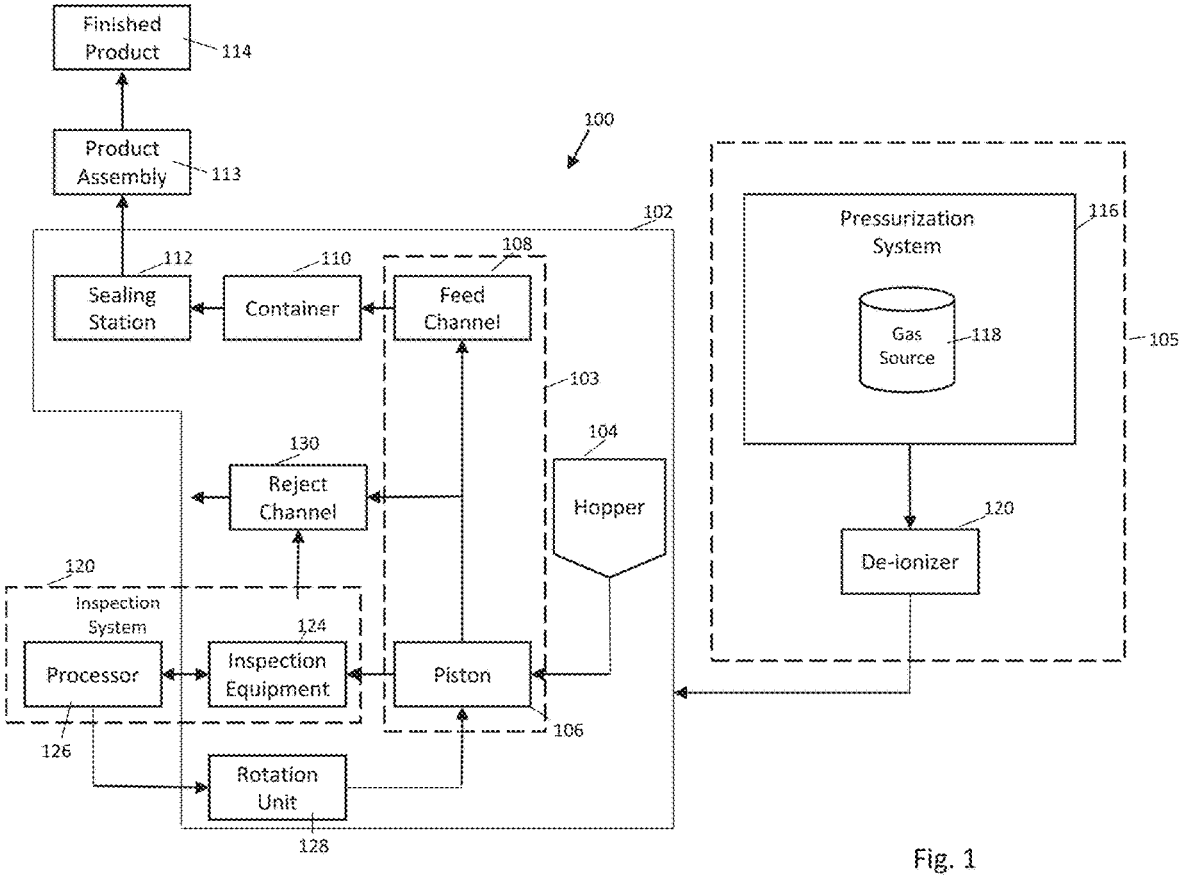
FIG. 1 is a schematic diagram of bead handling equipment in accordance with the present invention.

Referring to FIG. 1, bead handling equipment 100 in accordance with the present invention is illustrated. The illustrated equipment 100 generally includes an equipment housing 102 containing a hopper 104 and a bead dispenser 103, a gas delivery system 105, and an inspection system 120. Each of these components will be described in more detail below.

The equipment 100 is operative to controllably dispense a desired number of lyophilized beads to a container 110. The beads may be separately produced by other processes/equipment that are well known. The container 110 may further include a solution into which the beads are dissolved. The container may then be sealed at sealing station 112 to yield a container product. The container product may then, optionally, be loaded into a further medical device such as an injector or the like using product assembly equipment 113, to yield a finished product 114.

As shown, the equipment 100 includes a number of components housed within housing 102. The housing 102 may be sealed to support a positive pressure differential between an internal space of the housing 102 and the ambient environment. That is, the housing 102 may be pressurized. In this regard, the housing 102 may be pressurized by supplying pressurized gas to the housing 102 from the gas delivery system 105. The illustrated gas delivery system 105 includes a pressurization system 116 and a de-ionizer 120. The pressurization system 116 includes a gas source 118 and associated valves and/or other control elements to control delivery of gas from the gas source 118 to the housing 102.

Lyophilized beads are difficult to handle because the beads can be brittle or fragile. In addition, the beads can quickly degrade under certain environmental conditions and tend to stick together. In the illustrated equipment 100 the housing 102 is pressurized with a dry, inert, and de-ionized gas. In this regard, the gas source 118 may include a pressurized, inert gas such as helium, argon, nitrogen or the like. The gas preferably has a low relative humidity, e.g., less than 20% and, more preferably, no more than 10% relative humidity. The gas source 118 may be, for example, a pressurized bottle or canister, or may be a pressurized gas supply line from an external reservoir.

The gas is delivered from the pressurization system 116 to the housing 102 via a de-ionizer 120. The de-ionizer 120 applies an electrical field to the gas in the supply line to remove ions and neutralize any electrical charge of the gas. In this regard, the de-ionizer 120 may include electrodes or other discharge devices and the de-ionizer 120 may be configured such that gas remains in the de-ionizer 120 long enough to complete the discharge process. In this regard, the de-ionizer may include a pressurized storage tank or a circuitous path to provide the desired de-ionization time. The result in the illustrated system, is that a pressurized inert gas, having a low relative humidity and being substantially free of any electrical charge is delivered to the housing 102. Although not shown in detail, it will be appreciated that appropriate conduits and tubes with associated couplings are provided to connect the pressurization system 116 to the de-ionizer 120 and then to the housing 102.

The illustrated equipment 100 includes a hopper 104 for holding a supply of beads. For example, the hopper 104 may hold a supply of beads sufficient to fill many containers and allow for production runs of substantial time periods, e.g., several hours at typical production speeds. Beads are delivered from a bottom of the hopper 104 to a piston 106. The bottom of the hopper 104 may have a narrowing configuration, e.g., a funnel-like configuration, so that the beads are fed to the piston 106 in a single file or nearly single file stream. The beads are urged to the bottom of the hopper 104 and then to the piston 106 by gravity. In addition, the pressurization of the housing 102 further contributes to the transportation of the beads from the hopper 104 to the piston 106 as will be described in more detail below.

The piston 106 is operative to singulate individual beads from the stream of beads exiting the hopper 104 and to deliver individual beads to the feed channel 108. In particular, the piston 106 includes a hollow rod. The hollow rod is movable from a lowered position, where a top end of the rod is aligned with the stream of beads exiting the hopper 104, and a raised position where the top end of the rod is aligned with the feed channel 108. The rod is dimensioned such that a single bead can stably rest on the top end of the rod. In addition, the top end of the rod is exposed to the pressurized internal space of the housing 102 whereas the bottom end of the rod is exposed to the lower pressure of the ambient environment. For example, lower end of the rod may extend through a wall of the housing 102 or may otherwise vent to the external environment. Accordingly, there is a pressure differential across the rod to create a suction at the top end of the rod that securely holds an individual bead on the top end of the rod. If desired, a supplemental vacuum system may be employed to further reduce the pressure at the bottom end of the piston to increase the suction on the bead.

As noted above, the dry, de-ionized gas reduces sticking of adjacent beads. In combination with the noted suction, an individual bead is thus effectively separated from the stream of beads by raising the piston from the first position aligned with the bottom of the hopper to the second position aligned with the feed channel 108. The feed channel 108 is a channel or similar passageway extending to a feed port where individual beads are delivered to a container 110. The pressurization of the housing 102 also results in a pressure differential at the feed channel 108 such that the feed channel has a higher pressure where the piston 106 meets the feed channel 108 than at the feed port adjacent to the container 110. For example, gas may flow through the feed channel 108 towards an opening where finished product 114 exits the housing 102. This pressure differential is sufficient to blow the individual bead from the top end of the piston 106 through the feed channel and feed port to the container 110. In this regard, the force exerted on the bead by the pressure differential of the feed channel, integrated across the exposed surface area of the bead, is sufficient to overcome the suction force exerted on the bead by the piston 106. It will be appreciated that the suction force is exerted on a smaller surface area of the bead. If desired, the pressure differential in the feed channel 108 may be enhanced or the suction force of the piston 106 may be reduced or eliminated to facilitate transportation of an individual bead from the top of the piston 106 to the container 110.

As noted above, the container 110 may vary depending on the type of product being produced. In this regard, the container may be provided in the form of a vaccine container, a vial, a cartridge, an injector cylinder, or the like. In some cases, the container may then be sealed. For example, a membrane or other cover may be applied to an opening of the container 110 to seal the container. In the illustrated equipment 100, an appropriate sealing station 112 is provided within the housing 102. In this manner, the finished product 114 may include dry gas to reduce degradation of the enclosed product. Moreover, the pressurized housing 102 inhibits the entry of contaminants into the housing 102 and container 110.

As described above, the equipment 100 is well-adapted to avoid breaking or fragmentation of individual beads. Nonetheless, it may be desirable to inspect individual beads before dispensing the beads to the container 110 to ensure that the beads provide the desired volume of the reagent. The illustrated equipment 100 includes an inspection system 120 for identifying bead fragments, or beads that are otherwise mis-sized, so that such beads can be rejected and not delivered to the container 110. The illustrated inspection system 120 includes inspection equipment 124 associated with a processor 126. The inspection equipment 124 includes one or more sensors for sensing a physical characteristic of an individual bead on the piston 106 such as mass, dimension, or shape. In this regard, a variety of types of sensors may be utilized. In the illustrated embodiment, the inspection equipment 124 includes one or more cameras for obtaining one or more images of an individual bead on the piston 106. For example, a single camera may be used in combination with a rotation unit 128 that rotates the piston 106 so as to obtain multiple images from multiple viewpoints of a single bead on the piston 106. As will be described in more detail below, these images may be processed by a processor 126 to examine one or more features of the bead images so as to identify any mis-sized beads. Based on this analysis, the processor 126 may determine whether the bead is acceptable or unacceptable. For example, in order to be deemed acceptable, the bead may be required to have a measurement or score indicative of volume that is within a predetermined threshold of a target or nominal value. For example, the bead may be required to deviate from the target or nominal value by no more than, for example, 10% or, more preferably, no more than 5%. Such thresholds may be dynamically set depending on the nature of the finished product 114, requirements of a product vendor/purchaser, or applicable regulations.

If the bead is thereby determined to be acceptable, the bead may be delivered to a container 110 via the feed channel 108 as described above. However, if the bead is determined to be unacceptable, the bead may be removed from the piston 106 via a reject channel 130. The reject channel 130 is used to physically remove the bead from the top end of the piston so that the bead cannot be delivered to the feed channel 108. For example, the bead may be removed from the piston 106 by applying a pressure differential or suction/blowing force to the bead at the location of the reject channel 130. In this regard, the reject channel may be exposed to the higher internal pressure of the housing 102 at the end of the channel adjacent to the piston 106 and to a lower pressure such as the pressure of the ambient environment or an otherwise reduced pressure at the other end of the reject channel. A movable cover or controllable aperture may be utilized to selectively open and close the end of the channel 130 adjacent to the piston 106 or the other end in order to remove unacceptable beads and allow passage of acceptable beads to the feed channel 108. Such a movable cover may be operated by control signals from the processor 126. Alternatively, a suction device or blowing device may be operated by the processor 126 to selectively remove beads from the piston 106 via the reject channel 130.

Figure 2:
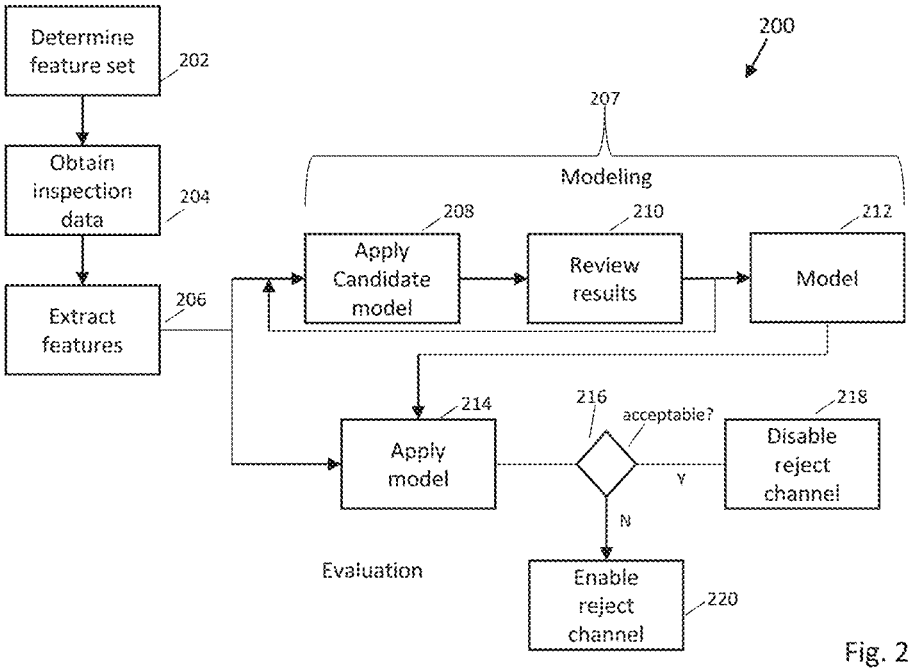
FIG. 2 is a schematic diagram of a bead inspection system in accordance with the present invention.

FIG. 2 further illustrates an inspection system 200 that may be employed in bead handling equipment in accordance with the present invention to identify and remove mis-sized beads. In the illustrated example, the system 200 implements a machine learning model to identify acceptable and/or unacceptable beads. The illustrated system 200 involves determining (202) a feature set that will be utilized to differentiate between acceptable and unacceptable beads. The feature set may be designed to differentiate between acceptable and unacceptable beads based on one or more parameters related to volume. It will be appreciated that, particularly for pharmaceutical/medical applications, the beads are intended to provide a known and precisely controlled volume of a reagent or reagents. Accordingly, any substantial variation from the desired or nominal volume can result in errors in dosing with respect to the finished product.

It will be appreciated that the selected features depend to some extent on the nature of the inspection equipment. Thus, for example, if the inspection equipment is operative to weigh or determine the mass of individual beads, the relevant features may be determined based on mass or weight. The illustrated inspection system 200 selects features in relation to visual or dimensional inspection equipment such as one or more images from a camera. In a preferred implementation, the inspection system 200 receives multiple images for a single bead corresponding to different perspectives or viewpoints. In some cases, the camera may be associated with lenses or filters to assist in measurement of phenomena such as color, polarization, or the like. In this context, examples of features that may be utilized include a maximum bead dimension for each image, difference in maximum bead dimension between images, circularity of the bead as determined in relation to one or more images, sphericality of the bead as determined in relation to multiple images, singularities as indicated by abrupt changes in dimension, color or changes in color with respect to one or more images, texture, absorption or reflectivity, polarization states, or any other parameter that can be measured from images and is indicative of volume, including indirect indications such as indications that a bead is broken or intact.

After a feature set has been determined, inspection data may be obtained (204). The inspection data may be obtained by receiving image data for one or more images as well as by implementing certain preprocessing such as removing artifacts and normalizing images, e.g., in relation to dimensions, intensity ranges, or the like. A processor is then operative to extract (206) features from the inspection data such as any of the features noted above. This may involve edge detection, dimensional measurements, curve fitting, or various other procedures and algorithms. The result is that a feature set is provided for a machine learning analysis.

The illustrated machine learning process 207 includes a modeling branch and an evaluation branch. In the modeling branch, a candidate model is applied (208) to the extracted feature set to yield results. The results may be, for example, an indication that a bead is acceptable or unacceptable, a value indicating a deviation of the bead from a target value, e.g., of volume, or other results. In the illustrated implementation, at least during a supervised phase of operation, these results may be reviewed (210) by a subject matter expert or technician. For example, the specific bead may be manually inspected, for example, visually or by measuring or weighing the bead. If this review indicates that the candidate model errored, such information may be provided in a feedback loop to update and refine the candidate model 208. The result is the development of a model 212 that is increasingly optimized in relation to accuracy in identifying acceptable and/or unacceptable beads.

In the evaluation branch, this model is applied (214) with respect to live data obtained by inspecting beads during a production run. The model then yields a result indicating whether or not the bead at issue is acceptable (216). If the bead is acceptable, the reject channel is disabled (218) such that the bead can pass to a feed channel and be delivered to a container. For example, an opening connecting a reject channel to the piston may be covered or uncovered such that the bead passes to the feed channel and to the container. If the bead is determined to be unacceptable, the reject channel is enabled such that the bead is removed and not passed to the container.

FIGS. 3A-3F show perspective views of feed handling equipment 300 generally corresponding to the schematic diagrams of FIGS. 1-2. The equipment 300 generally includes a hopper 302, a feed piston 304, and a feed channel 306. Gravity feeds beads to the feed piston 304 to maintain a steady supply of beads in a bead channel connecting the bottom of the hopper 302 to the piston 304. As noted above, the hopper 302 and the feed channel are provided in an enclosure 301 that is sealed and maintains a positive pressure in relation to the external or ambient environment. This pressure assists in urging beads from the hopper 302 to the piston 304. The hopper 302 is dimensioned to hold a high capacity of beads, for example, supporting several hours of production. The enclosure 301 may be purged with dry air or inert gas such as helium, argon, nitrogen, or the like.

The feed piston 304 lifts beads one at a time into a feed channel 318. In this regard, the piston 304 may include a hollow rod 314. The bottom end of the rod 314 may be in communication with the ambient environment such that a pressure gradient across the rod 314 creates suction on the bead 316. As will be discussed in more detail below, the feed piston 304 may be rotated by a rotation unit 332 to allow inspection of the bead 316 from multiple angles.

The feed channel 318 guides beads 316 as they flow from the equipment 300 to a container at the outlet 320. In this regard, the beads 316 are urged through the channel 318 to the outlet 320 due to the pressurization of the enclosure 301. That is, the outlet 320 may be exposed to ambient air pressure so that a gas flow is induced through the channel 318 towards the outlet 320. Although a single channel 318 and a single outlet 320 are shown, it will be appreciated that multiple channels with multiple outlets feeding multiple containers may be provided, for example, with appropriate valves and/or diaphragms to control the delivery of the beads to the different containers.

As noted above, it is desirable to provide a controlled environment in the enclosure 301. In this regard, dry air or inert gas having a relative humidity, that is preferably below about 10%, is piped into the enclosure 301. The air is piped through a de-ionizing nozzle as generally indicated at reference numeral 308 that eliminates static that might be present in the dry environment. The dry air circulates throughout the enclosure 301 as generally indicated by arrows 311 thereby purging moisture from the enclosure and maintaining a small positive pressure differential relative to the ambient environment. As noted above, this differential pressure assists in feeding beads to the container as well as holding the bead 316 on the hollow rod 314 of the piston. In this manner, the bead 316 is held on the rod 314 even if the bead 316 contacts other beads as it is lifted to the feed channel 318.

Figure 3A:
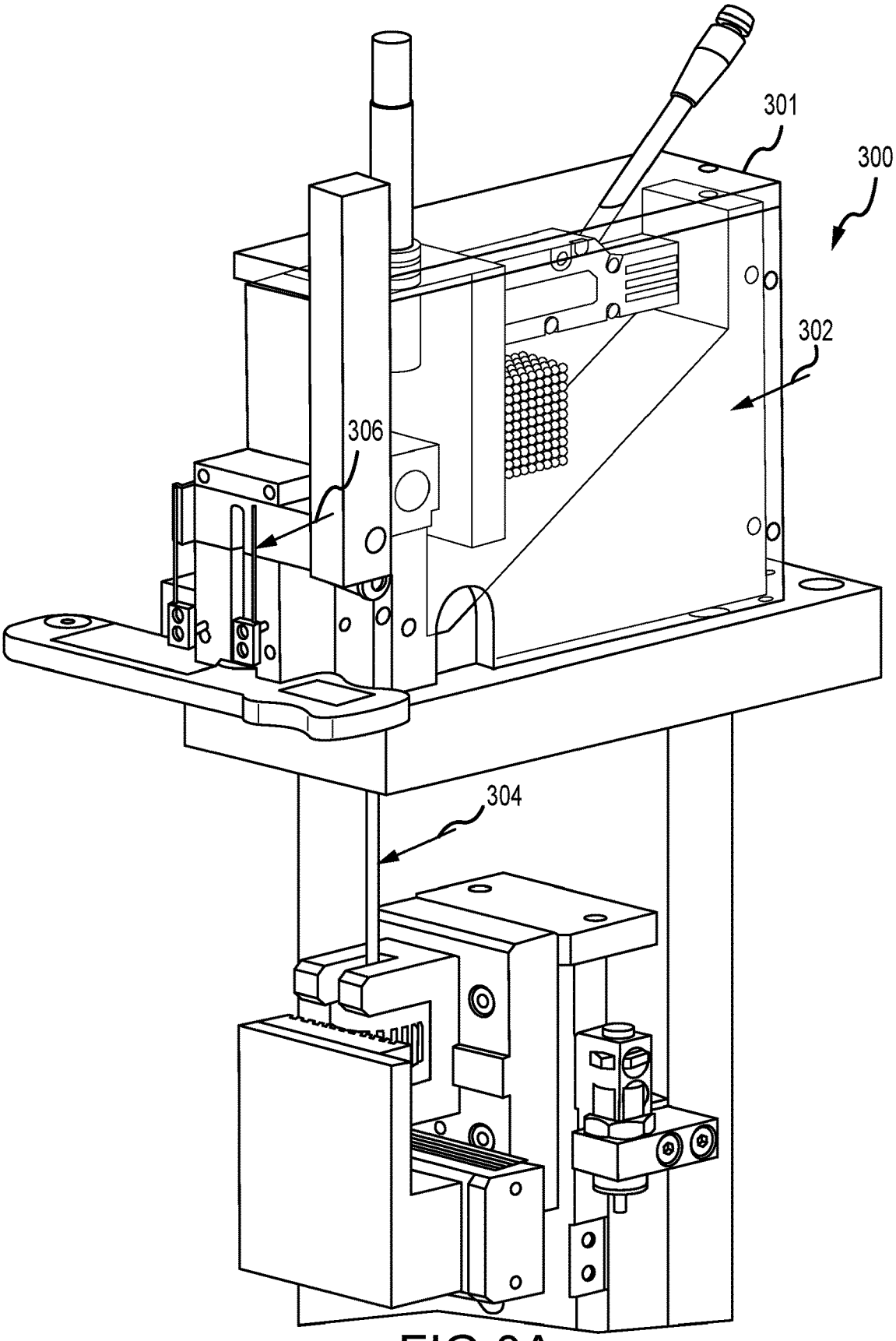
FIG. 3A-3F is a perspective view of bead handling equipment in accordance with the present invention.
Figure 3B:
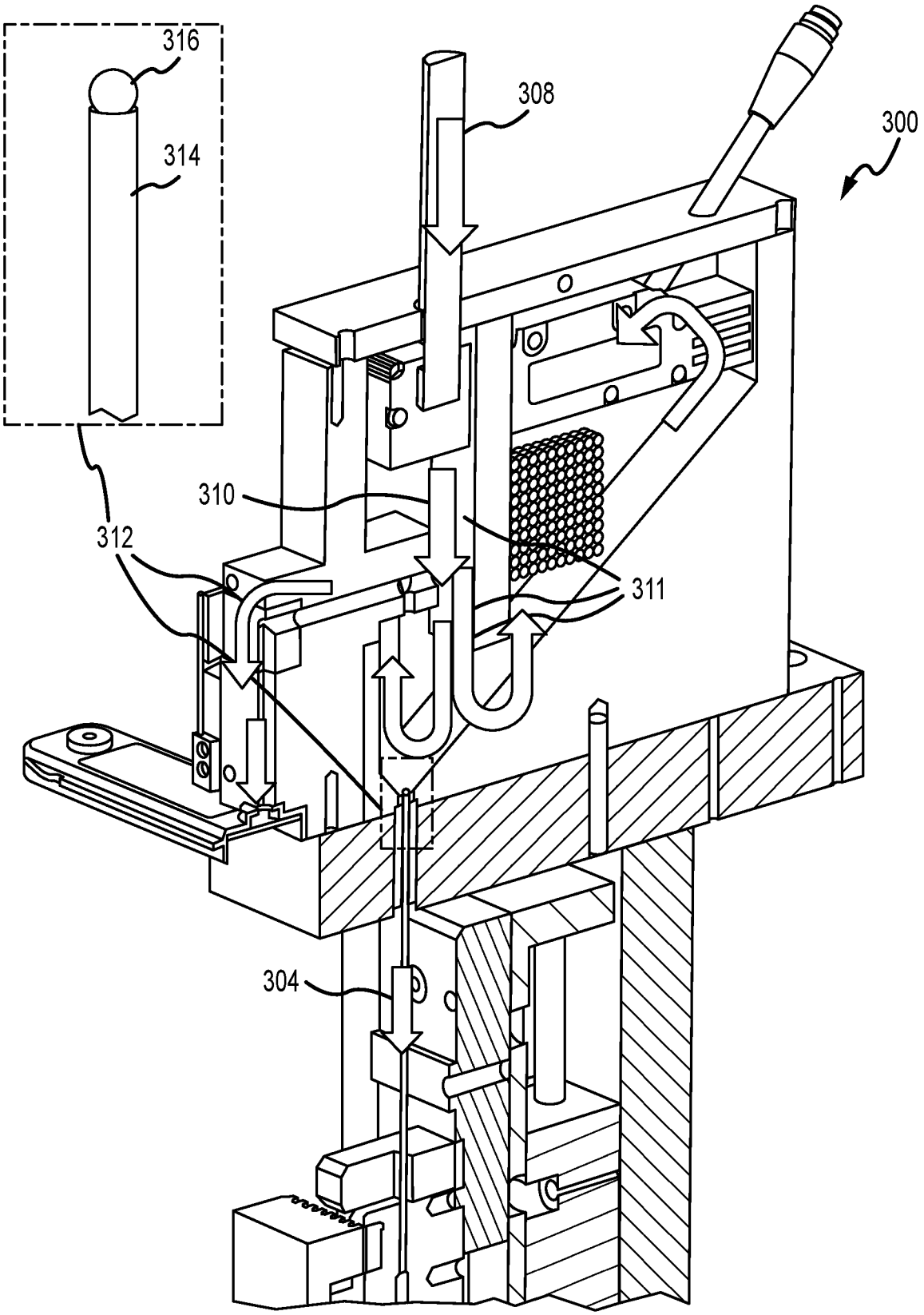
Figure 3C:
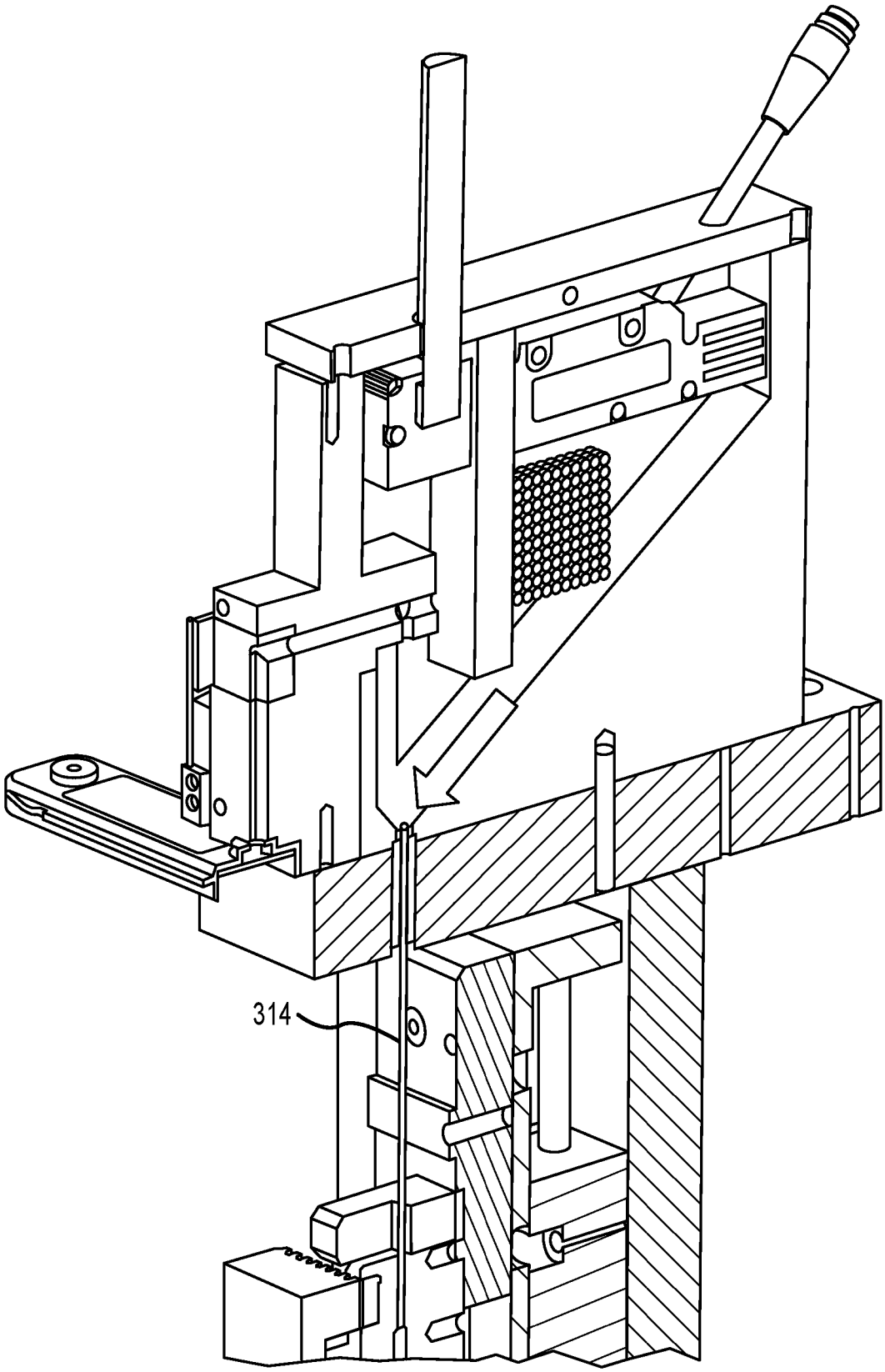
Figure 3D:
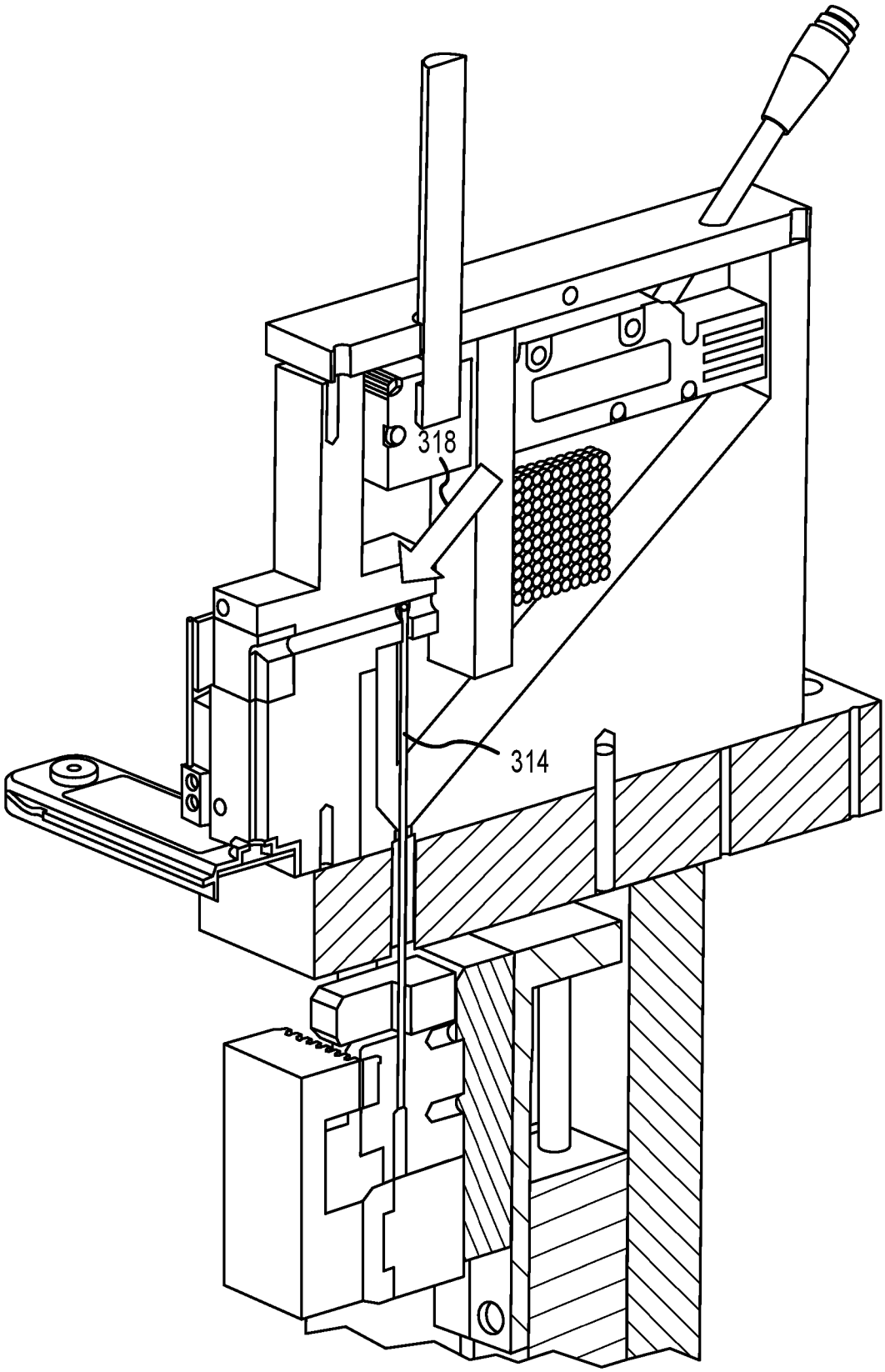
Figure 3E:
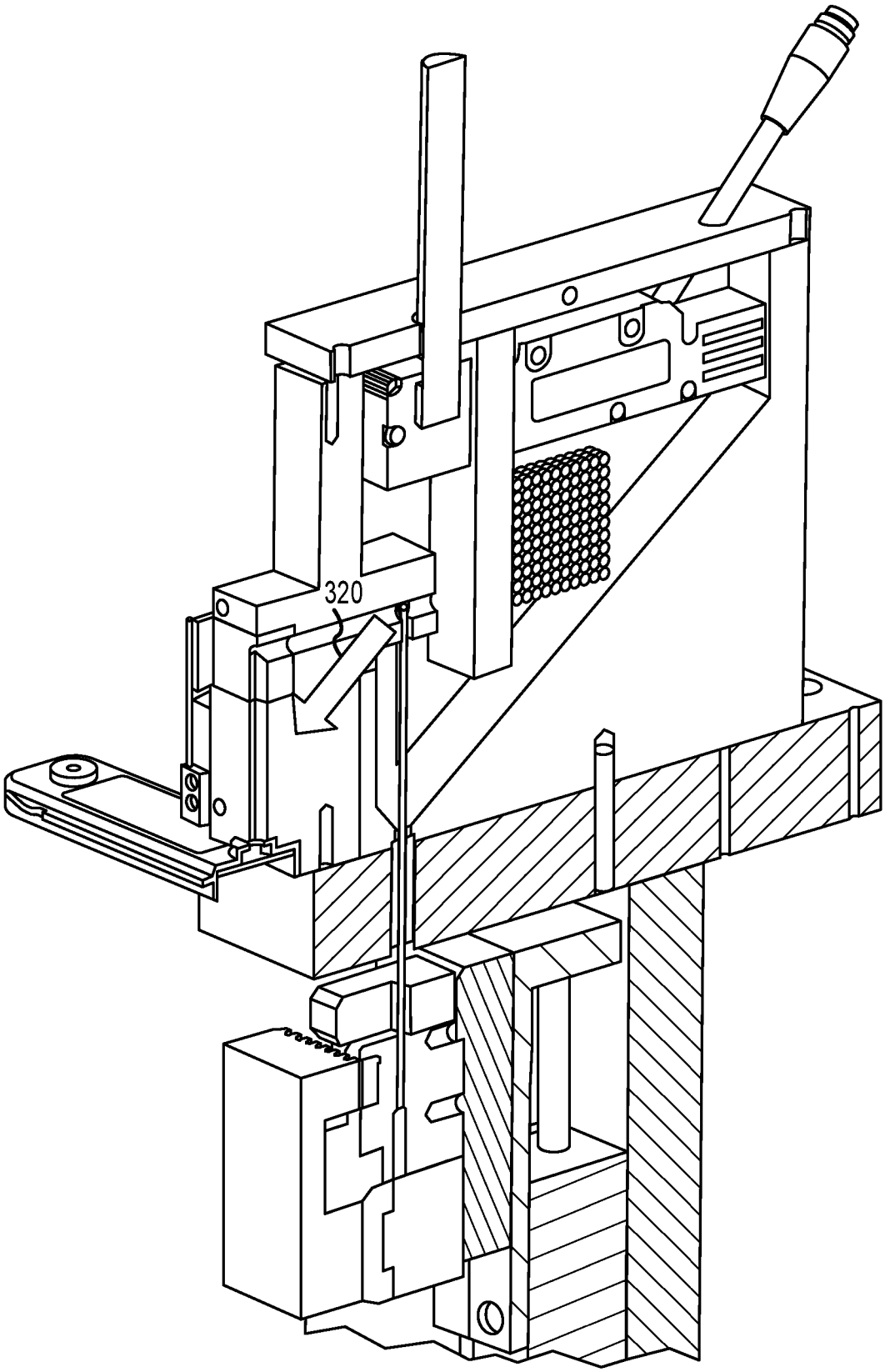

FIGS. 3C-3E illustrate the progressive movement of a bead 316 through the equipment 300. As shown in FIG. 3C, the piston 304 first picks up a bead 316 from the bottom of the hopper 302. The feed piston 304 then lifts the bead into the feed channel 318 as shown in FIG. 3D. Finally, differential pressure carries the bead 316 through the channel 318 into a desired container at the outlet 320 as shown in FIG. 3E.

Figure 3F:
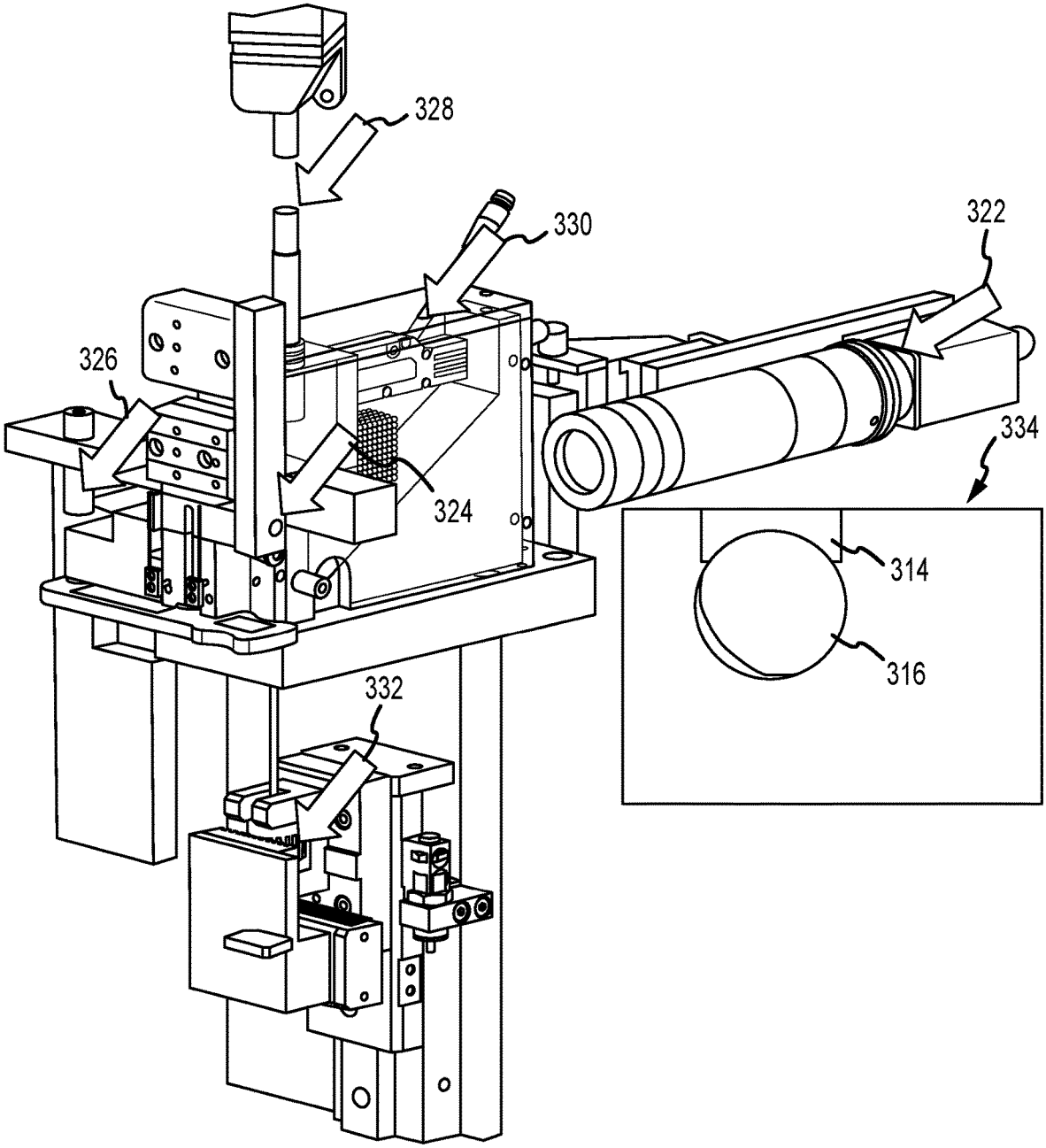

The equipment 300 may include a number of additional optional elements as illustrated in FIG. 3F. As noted above, the equipment 300 may include a bead inspection unit 322. The bead inspection unit 322 may include any type of inspection unit effective to provide an indication of bead volume or mass. For example, the inspection unit 322 may include one or more cameras for providing images of a bead 316 held by the feed piston 304. In the illustrated embodiment, the inspection system 322 includes a camera with a mirror and backlight for providing an indication of bead volume. The camera may work in conjunction with a feed piston rotation unit 332 to rotate the piston 304 thereby allowing for multiple inspection images from multiple angles. One such image 334 is depicted. The image 334 shows a bead 316 on the end of the hollow rod 314. As shown, this image 334 indicates that the bead 316, as depicted in the plane of the image, is not round. Various dimensions may be measured (e.g., maximum and minimum cross-sectional dimension) or other parameters, for example, related to roundness or shape may be obtained in relation to each image. Multiple images for a single bead 316 may then be processed using appropriate algorithms to obtain information regarding the volume or mass of the bead. The information from the images may be combined (e.g., to generate a composite measure of volume) or used separately (e.g., to identify a maximum departure from roundness or total number of departures from roundness) to obtain information for accepting or rejecting a bead. Such processing may concurrently or sequentially address the objectives of speed of processing and accuracy of dosing.

The illustrated equipment 300 may further include a bead reject channel 324. The reject channel 324 is used to eject beads 316 that are deemed unacceptable, e.g., due to deviation from a desired mass or volume that exceeds a deviation threshold. In this regard, and ejection system associated with the reject channel 324 may be in communication with a controller that identifies unacceptable beads based on information from the inspection system 322. For example, a gas jet may be activated to divert beads from the piston 304 through the reject channel 324 if the bead is unacceptable. Alternatively, valves or diaphragms may be activated to redirect beads through the reject channel 324. The beads 316 ejected through the reject channel 324 may be allowed to fall to the bottom of the enclosure 301 or may be collected in a separate container.

The equipment 300 may further include a static elimination ionizer 328. The ionizer 328 neutralizes the charge of the incoming dry air or inert gas to eliminate static. In this manner, sticking or clinging of beads 316 may be reduced or substantially eliminated to enhance bead singulation and enhance controlled delivery of beads to the containers. The equipment 300 may further include static and relative humidity sensors 332 provide feedback concerning the internal environment of the enclosure 301. This feedback may be used to control the environment by changing the operating parameters of the static elimination ionizer 328 and the gas delivery system.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. An apparatus for singulating and dispensing beads, comprising:

a hopper for holding a supply of beads for dispensing to a product container, said hopper including an enclosure defining an internal space for holding said beads;

a bead dispenser for dispensing said beads, one at a time, to said product container, said bead dispenser comprising a dispensing mechanism adapted to receive beads from said hopper and deliver said beads to a dispensing outlet associated with said product container, wherein said bead dispenser comprises a piston for separating individual beads from a stream of beads from said hopper and said piston is configured to lift an individual bead from a bottom of said hopper to said outlet, said outlet being disposed above said bottom of said hopper; and a pressurization system for maintaining a positive pressure, at said internal space of said enclosure, in relation to an external environment.

2. The apparatus as set forth in claim 1, wherein said pressurization system comprises a source of gas connected to said hopper to provide said positive pressure.

3. The apparatus as set forth in claim 1, wherein said pressurization system is operative to deliver, to said hopper, dry air having a relative humidity of no more than about 10%.

4. The apparatus as set forth in claim 1, wherein said pressurization system comprises a de-ionizer for neutralizing an electrical charge of the gas.

5. The apparatus as set forth in claim 1, wherein said piston is movable from a first position aligned with said bottom of said hopper and a second position aligned with said outlet.

6. The apparatus as set forth in claim 1, wherein said piston has an axial channel extending across a length of said piston.

7. The apparatus as set forth in claim 1, wherein said axial channel is exposed to said positive pressure at a first end thereof and to an ambient pressure of said external environment at a second end thereof.

8. The apparatus as set forth in claim 1, wherein said outlet comprises a feed channel for delivering said individual bead to said product container.

9. The apparatus as set forth in claim 8, wherein said feed channel extends from a first location adjacent to a path of said piston to a feed port for feeding beads into said product container.

10. The apparatus as set forth in claim 9, wherein said feed channel is in fluid communication with said hopper such that said positive pressure provides a pressure differential in said feed channel to urge said beads from said first location to said feed port.

11. The apparatus as set forth in claim 1, further comprising an inspection system for inspecting one or more physical characteristics of said beads.

12. The apparatus as set forth in claim 11, wherein said inspection system is operative for inspecting an individual bead supported on said piston.

13. The apparatus as set forth in claim 12, wherein said inspection system comprises a camera for imaging said individual bead.

14. The apparatus as set forth in claim 13, wherein said inspection system further comprises a processor, associated with said camera, for determining one or more values associated with a volume of said individual bead.

15. The apparatus as set forth in claim 14, wherein said processor executes functionality for identifying one or more features of said individual bead and applying machine learning logic relative to said one or more features to determine whether said individual bead is acceptable.

16. The apparatus as set forth in claim 13, further comprising a piston rotation unit for rotating said piston so as to facilitate said imaging of said individual bead.

17. A method for singulating and dispensing beads, comprising:

providing a supply of beads in a hopper for dispensing to a product container, said hopper including an enclosure defining an internal space for holding said beads;

dispensing said beads, one at a time, to said product container using a bead dispenser, said bead dispenser comprising a dispensing mechanism adapted to receive beads from said hopper and deliver said beads to a dispensing outlet associated with said product container, wherein said dispensing comprises operating a piston for separating individual beads from a stream of beads from said hopper and said piston is configured to lift an individual bead from a bottom of said hopper to said outlet, said outlet being disposed above said bottom of said hopper; and maintaining a positive pressure, at said internal space of said enclosure, in relation to an external environment.

18. The method as set forth in claim 17, wherein said maintaining a positive pressure comprises connecting a source of gas to said hopper to provide said positive pressure.

19. The method as set forth in claim 17, wherein said maintaining a positive pressure comprises delivering, to said hopper, dry air having a relative humidity of no more than about 10%.

20. The method as set forth in claim 17, wherein said maintaining a positive pressure comprises neutralizing an electrical charge of gas delivered to said hopper.

21. The method as set forth in claim 17, further comprising operating an inspection system for inspecting one or more physical characteristics of said beads.

22. The method as set forth in claim 21, wherein said inspection system is operative for inspecting an individual bead supported on said piston.

23. The method as set forth in claim 22, wherein said inspection system comprises a camera for imaging said individual bead.

24. The method as set forth in claim 23, further comprising operating a processor, associated with said camera, for determining one or more values associated with a volume of said individual bead.

25. The method as set forth in claim 24, wherein said processor executes functionality for identifying one or more features of said individual bead and applying machine learning logic relative to said one or more features to determine whether said individual bead is acceptable.

26. The method as set forth in claim 25, further comprising operating a piston rotation unit for rotating said piston so as to facilitate said imaging of said individual bead.

27. An apparatus for singulating and dispensing beads, comprising:

a hopper for holding a supply of beads for dispensing to a product container, said hopper including an enclosure defining an internal space for holding said beads;

a bead dispenser for dispensing said beads, one at a time, to said product container, said bead dispenser comprising a dispensing mechanism adapted to receive beads from said hopper and deliver said beads to a dispensing outlet associated with said product container;

a pressurization system for maintaining a positive pressure, at said internal space of said enclosure, in relation to an external environment;

an inspection system for inspecting one or more physical characteristics of said beads, said inspection system being operative for inspecting an individual bead supported on said piston, wherein said inspection system comprises a camera for imaging said individual bead; and a piston rotation unit for rotating said piston so as to facilitate said imaging of said individual bead.

28. A method for singulating and dispensing beads, comprising:

providing a supply of beads in a hopper for dispensing to a product container, said hopper including an enclosure defining an internal space for holding said beads;

dispensing said beads, one at a time, to said product container using a bead dispenser, said bead dispenser comprising a dispensing mechanism adapted to receive beads from said hopper and deliver said beads to a dispensing outlet associated with said product container;

maintaining a positive pressure, at said internal space of said enclosure, in relation to an external environment;

operating an inspection system for inspecting one or more physical characteristics of said beads, wherein said inspection system is operative for inspecting an individual bead supported on said piston and said inspection system comprises a camera for imaging said individual bead; and operating a piston rotation unit for rotating said piston so as to facilitate said imaging of said individual bead.

* * * * *